US006691528B2

(12) United States Patent
Stensrud et al.

(10) Patent No.: US 6,691,528 B2
(45) Date of Patent: Feb. 17, 2004

(54) QUIET ICE MAKING APPARATUS

(75) Inventors: Gerald J. Stensrud, Mallard, IA (US); Daniel Leo Ziolkowski, Barrington, IL (US); Matthew W. Allison, Mundelein, IL (US); David Brett Gist, Grayslake, IL (US)

(73) Assignees: Scotsman Ice Systems, Vernon Hills, IL (US); Mile High Equipment Co., Denver, CO (US)

( * ) Notice: Subject to any disclaimer, the term of this patent is extended or adjusted under 35 U.S.C. 154(b) by 0 days.

(21) Appl. No.: 10/147,441

(22) Filed: May 16, 2002

(65) Prior Publication Data

US 2002/0189270 A1 Dec. 19, 2002

Related U.S. Application Data

(63) Continuation-in-part of application No. 09/952,143, filed on Sep. 14, 2001.

(60) Provisional application No. 60/233,392, filed on Sep. 15, 2000.

(51) Int. Cl.[7] ..... F25C 5/18

(52) U.S. Cl. ..... 62/344; 62/507

(58) Field of Search ..... 62/196.2, 507, 62/344

(56) References Cited

U.S. PATENT DOCUMENTS

| | | | | | |
|---|---|---|---|---|---|
| 3,358,469 | A | * | 12/1967 | Quick | 62/196.2 |
| 3,838,582 | A | | 10/1974 | Redfern et al. | 62/196 |
| 3,865,517 | A | * | 2/1975 | Simmons et al. | 417/424.1 |
| 3,922,875 | A | | 12/1975 | Morris, Jr. | 62/156 |
| 4,013,120 | A | | 3/1977 | Rheinheimer | 165/48 |
| 4,089,040 | A | | 5/1978 | Paulsen | 361/383 |
| 4,185,467 | A | | 1/1980 | Garland | 62/81 |
| 4,276,751 | A | | 7/1981 | Saltzman et al. | 62/138 |
| 4,324,109 | A | | 4/1982 | Garland | 62/353 |
| 4,373,345 | A | | 2/1983 | Tyree, Jr. et al. | 62/79 |
| 4,378,680 | A | | 4/1983 | Garland | 62/352 |
| 4,625,524 | A | | 12/1986 | Kimura et al. | 62/278 |
| 4,774,815 | A | | 10/1988 | Schlosser | 62/149 |
| 4,878,361 | A | | 11/1989 | Kohl et al. | 62/352 |
| 4,907,422 | A | | 3/1990 | Kohl et al. | 62/352 |
| 4,981,023 | A | | 1/1991 | Krishnakumar et al. | 62/498 |
| 5,058,395 | A | | 10/1991 | Ni et al. | 62/278 |
| 5,131,234 | A | | 7/1992 | Furukawa et al. | 62/137 |
| 5,167,130 | A | | 12/1992 | Morris, Jr. | 62/196.1 |
| 5,174,123 | A | | 12/1992 | Erickson | 62/113 |
| 5,218,830 | A | | 6/1993 | Martineau | 62/73 |
| 5,363,671 | A | | 11/1994 | Forsythe et al. | 62/197 |
| 5,787,723 | A | | 8/1998 | Mueller et al. | 62/347 |
| 5,842,352 | A | | 12/1998 | Gregory | 62/151 |
| 6,009,715 | A | | 1/2000 | Sakurai et al. | 62/197 |
| 6,145,324 | A | | 11/2000 | Dolezal | 62/73 |
| 6,196,007 | B1 | | 3/2001 | Schlosser et al. | 62/73 |

OTHER PUBLICATIONS

Kold Draft Service Manual (W4000), 1990.

Crystal Tips Ice Machine CAE 101B Service Manual, Apr. 1974.

Vogt HEC Series Tube–Ice machines Service Manual, Jun. 27, 1995.

International Search Report Application No. PCT/US01/42164 filed on Sep. 14, 2001 dated Jan. 23, 2002.

* cited by examiner

*Primary Examiner*—William E. Tapolcai

(74) *Attorney, Agent, or Firm*—Ohlandt, Greeley, Ruggiero & Perle, LLP

(57) ABSTRACT

An ice cube-making machine that is characterized by noiseless operation at the location where ice cubes are dispensed and be lightweight packages for ease of installation. The ice cube-making machine has an evaporator package, a separate compressor package and a separate condenser package. Each of these packages has a weight that can generally by handled by one or two installers for ease of installation. The noisy compressor and condenser packages can be located remotely of the evaporator package. The maximum height distance between the evaporator package and the condenser package is greatly enhanced by the three package system. A pressure regulator operates during a harvest cycle to limit flow of refrigerant leaving the evaporator, thereby increasing pressure and temperature of the refrigerant in the evaporator and assisting in defrost thereof.

16 Claims, 10 Drawing Sheets

QUIET ICE MAKING APPARATUS

This Application is a continuation in part of U.S. patent application Ser. No. 09/952,143 filed on Sep. 14, 2001 and claims the benefit of U.S. Provisional Application No. 60/233,392, filed Sep. 15, 2000.

FIELD OF INVENTION

This invention relates to an ice cube-making machine that is quiet at the location where ice is dispensed.

BACKGROUND OF INVENTION

Ice cube-making machines generally comprise an evaporator, a water supply and a refrigerant/warm gas circuit that includes a condenser and a compressor. The evaporator is connected to the water supply and to a circuit that includes the condenser and the compressor. Valves and other controls control the evaporator to operate cyclically in a freeze mode and a harvest mode. During the freeze mode, the water supply provides water to the evaporator and the circuit supplies refrigerant to the evaporator to cool the water and form ice cubes. During the harvest mode, the circuit diverts warm compressor discharge gas to the evaporator, thereby warming the evaporator and causing the ice cubes to loosen and fall from the evaporator into an ice bin or hopper.

When installed in a location, such as a restaurant, where a small footprint is needed, ice making machines have been separated into two separate packages or assemblies. One of the packages contains the evaporator and the ice bin and is located within the restaurant. The other package contains the compressor and condenser, which are rather noisy. This package is located remotely from the evaporator, for example, outside the restaurant on the roof. The evaporator package is relatively quiet as the condenser and compressor are remotely located.

This two package ice cube-making machine has some drawbacks. It is limited to a maximum height distance of about 35 feet between the two packages because of refrigerant circuit routing constraints. Additionally, the compressor/condenser package weighs in excess of about 250 pounds and requires a crane for installation. Furthermore, service calls require the mechanic to inspect and repair the compressor/condenser package in the open elements, since it is typically located on the roof of a building. Due to inclement weather, it would be highly desirable to be able to work on the compressor in doors, since it is only the condenser that requires venting to the atmosphere.

During harvest mode, the condenser is bypassed so that refrigerant is supplied from the compressor in vapor phase to the evaporator. When the compressor is located a distance from the evaporator, the refrigerant tends to partially change to liquid phase as it traverses the distance, thereby affecting the efficiency warming or defrosting the evaporator. One prior art solution to this problem uses a heater to heat the vapor supply line. Another prior art solution locates a receiver in the same package as the evaporator and uses the vapor ullage of the receiver to supply vapor to the evaporator. Both of these solutions increase the size of the package and, hence, its footprint in a commercial establishment.

Thus, there is a need for a quiet ice cube-making machine that has a larger height distance between the evaporator and the condenser and a lighter weight for installation without the need for a crane.

There is also a need for an efficient way of providing vapor to an evaporator during harvest mode.

There is a continuing need for a low profile ice making apparatus which overcomes known installation problems.

There is also a need for an ice cube-making machine that has a compact configuration of multiple condensers and a lighter weight for installation.

SUMMARY OF INVENTION

The ice cube-making machine of the present invention satisfies the first need with a three package system. The condenser, compressor and evaporator are located in separate ones of the packages, thereby reducing the weight per package and eliminating the need for a crane during installation. The compressor package can be located up to 35 feet in height from the evaporator package. For example, the evaporator package can be located in a restaurant room where the ice cubes are dispensed and the compressor package can be located in a separate room on another floor of the building, such as a utility room. This allows for service thereof to be made indoors, rather than outdoors as required by prior two package systems. The condenser package can be located up to 35 feet in height from the compressor package. For example, the condenser package can be located on the roof of the multistory building.

The evaporator package has a support structure that supports the evaporator. The compressor package has a support structure that supports the compressor. The condenser package has a support structure that supports the condenser.

The present invention satisfies the need for providing vapor to the evaporator during harvest mode by increasing the pressure and temperature of the refrigerant in the evaporator. This is accomplished by connecting a pressure regulator in circuit with the return line between the evaporator and the compressor. The pressure regulator limits flow, which increases pressure and temperature of the refrigerant in the evaporator. To achieve a small footprint of the evaporator package, the pressure regulator can be located in the compressor package.

BRIEF DESCRIPTION OF DRAWING

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

Figure 1:
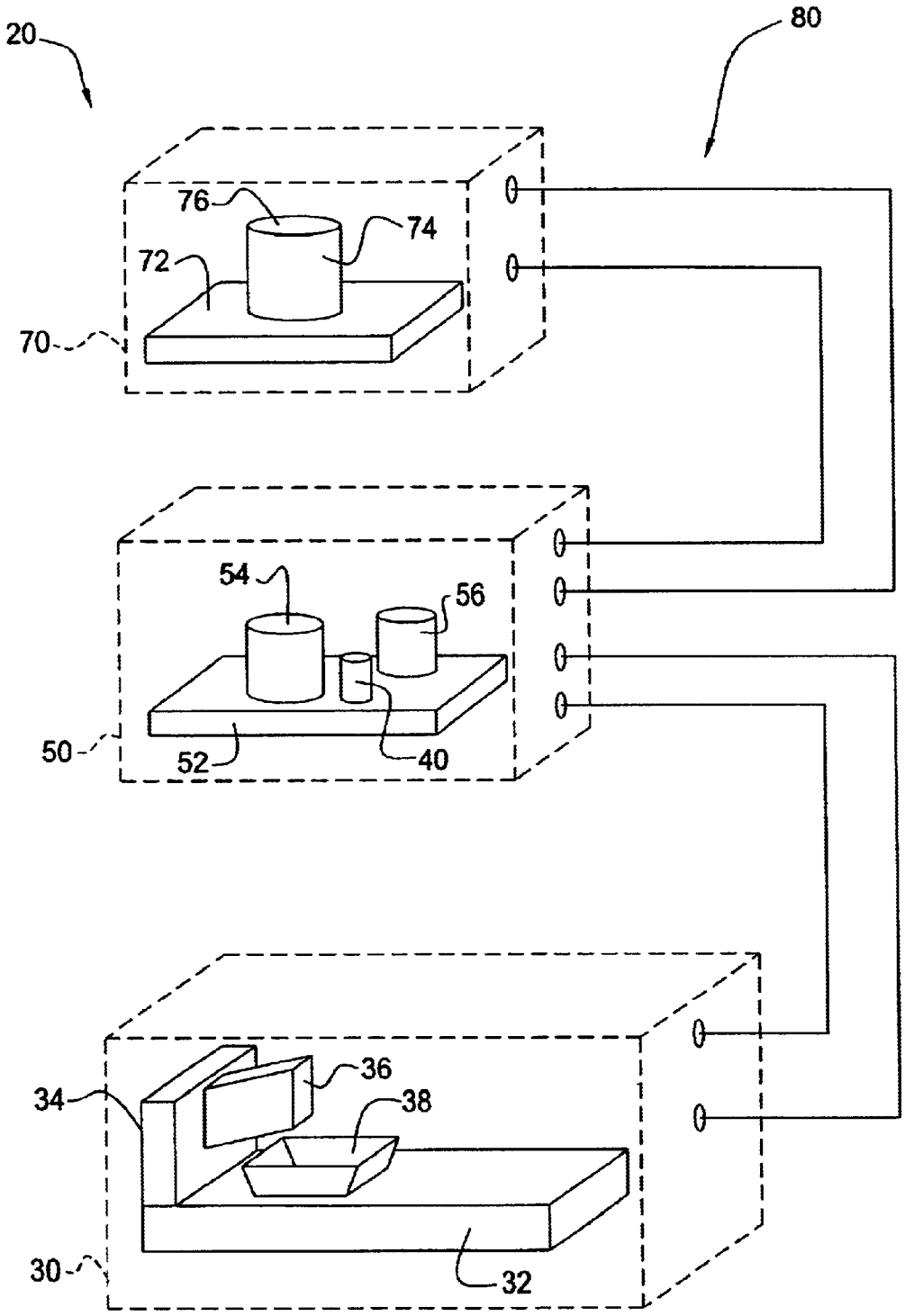
FIG. 1 is a perspective view, in part, and a block diagram, in part, of the quiet ice cube-making machine of the present invention.

Referring to FIG. 1, an ice cube-making machine 20 of the present invention includes an evaporator package 30, a compressor package 50, a condenser package 70 and an interconnection structure 80. Evaporator package 30 includes a support structure 32 that has an upwardly extending member 34. An evaporator 36 is supported by support structure 32 and upwardly extending member 34. An ice bin or hopper 38 is disposed beneath evaporator 36 to receive ice cubes during a harvest mode.

Compressor package 50 includes a support structure 52 upon which is disposed a compressor 54, an accumulator 56 and a receiver 40. Condenser package 70 includes a support structure 72 upon which is disposed a condenser 74 and a fan 76. It will be appreciated by those skilled in the art that support structures 32, 52 and 72 are separate from one another and may take on different forms and shapes as dictated by particular design requirements. It will be further appreciated by those skilled in the art that evaporator package 30, compressor package 50 and condenser package 70 suitably include various valves and other components of an ice cube-making machine.

Interconnection structure 80 connects evaporator 36, compressor 54 and condenser 74 in a circuit for the circulation of refrigerant and warm gas. Interconnection structure 80 may suitably include pipes or tubing and appropriate joining junctions.

Figure 2:
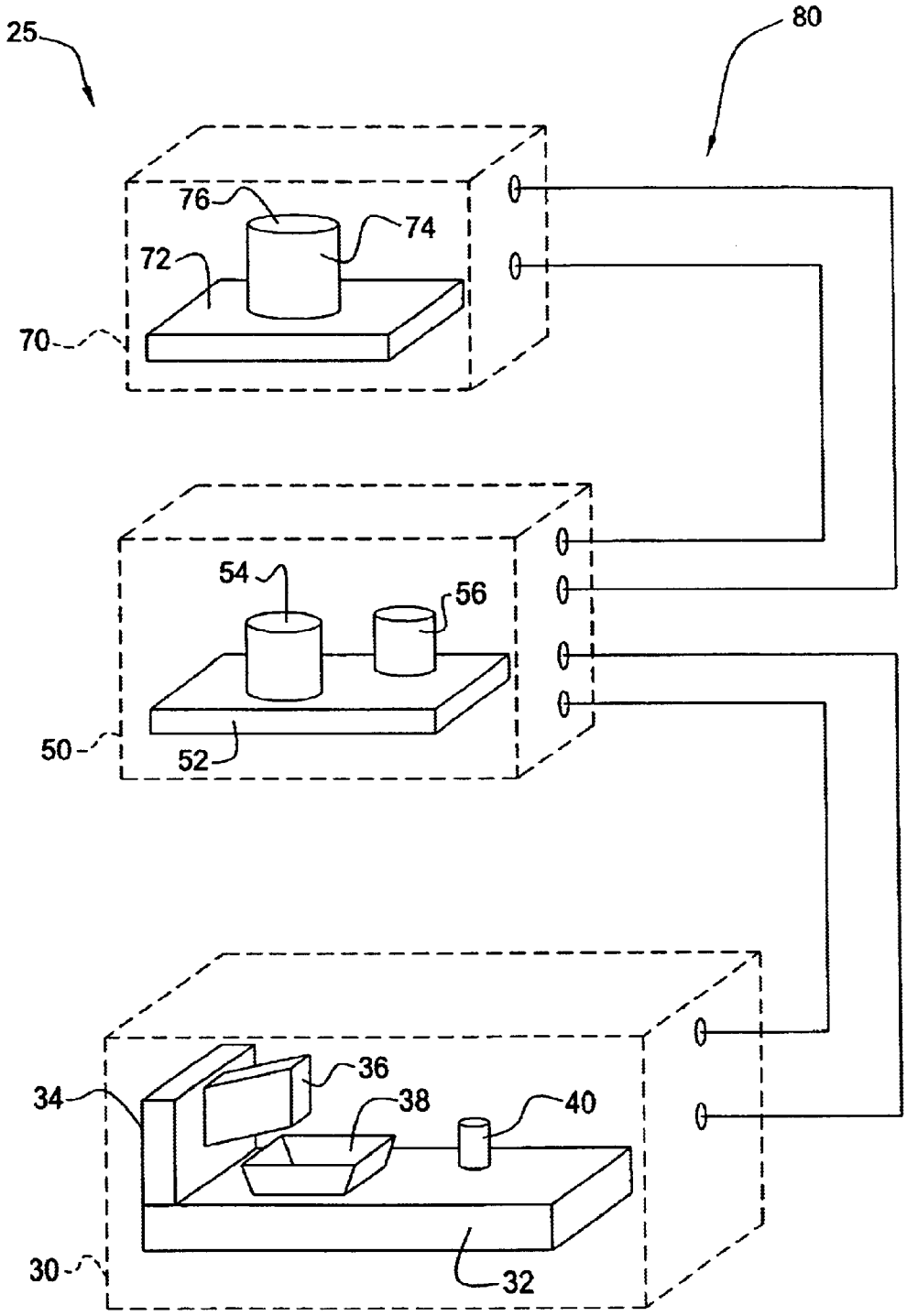
FIG. 2 is a perspective view, in part, and a block diagram, in part, of an alternative embodiment of the quiet ice cube-making machine of the present invention.

Referring to FIG. 2, an ice-making machine 25 is identical in all respects to ice making machine 20, except that receiver 40 is disposed on support structure 32 in evaporator package 30 rather than in compressor package 50.

Figure 3:
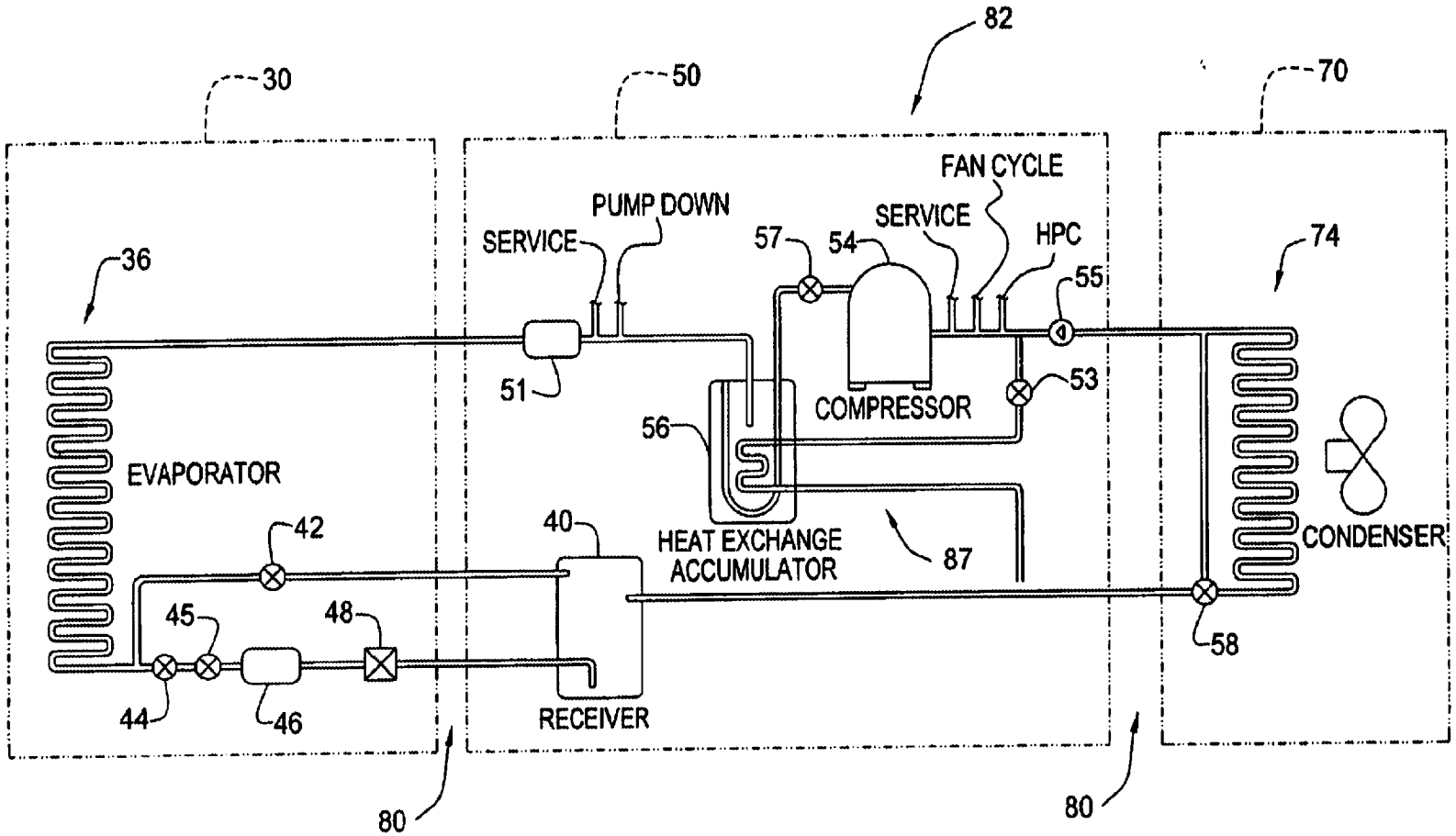
FIG. 3 is a circuit diagram of a refrigerant/warm gas circuit that can be used for the quiet ice cube-making machine of FIG. 1.

Referring to FIG. 3, a circuit 82 is shown that may be used with the FIG. 1 ice cube-making machine. Circuit 82 includes interconnection structure 80 that connects the components within compressor package 50 to the components within evaporator package 30 and to the components within condenser package 70. In evaporator package 30, evaporator 36 is connected in circuit 82 with a defrost valve 42, an expansion valve 44, a liquid line solenoid valve 45, a drier 46 and an isolation valve 48. In compressor package 50, receiver 40, compressor 54 and accumulator 56 are connected in circuit 82 with a filter 51, a bypass valve 53, a check valve 55 and an output pressure regulator 57. In condenser package 70, condenser 74 is connected in circuit 82 with a head pressure control valve 58. Head pressure control valve 58 may alternatively be placed in compressor package 50. It will be appreciated by those skilled in the art that evaporator package 30, compressor package 50 and condenser package 70 may include other valves and controls for the operation of ice cube-making machine 20. A heat exchanger loop 87 is in thermal relationship with the liquid refrigerant in accumulator so as to optimize the use thereof during the freeze cycle.

Figure 4:
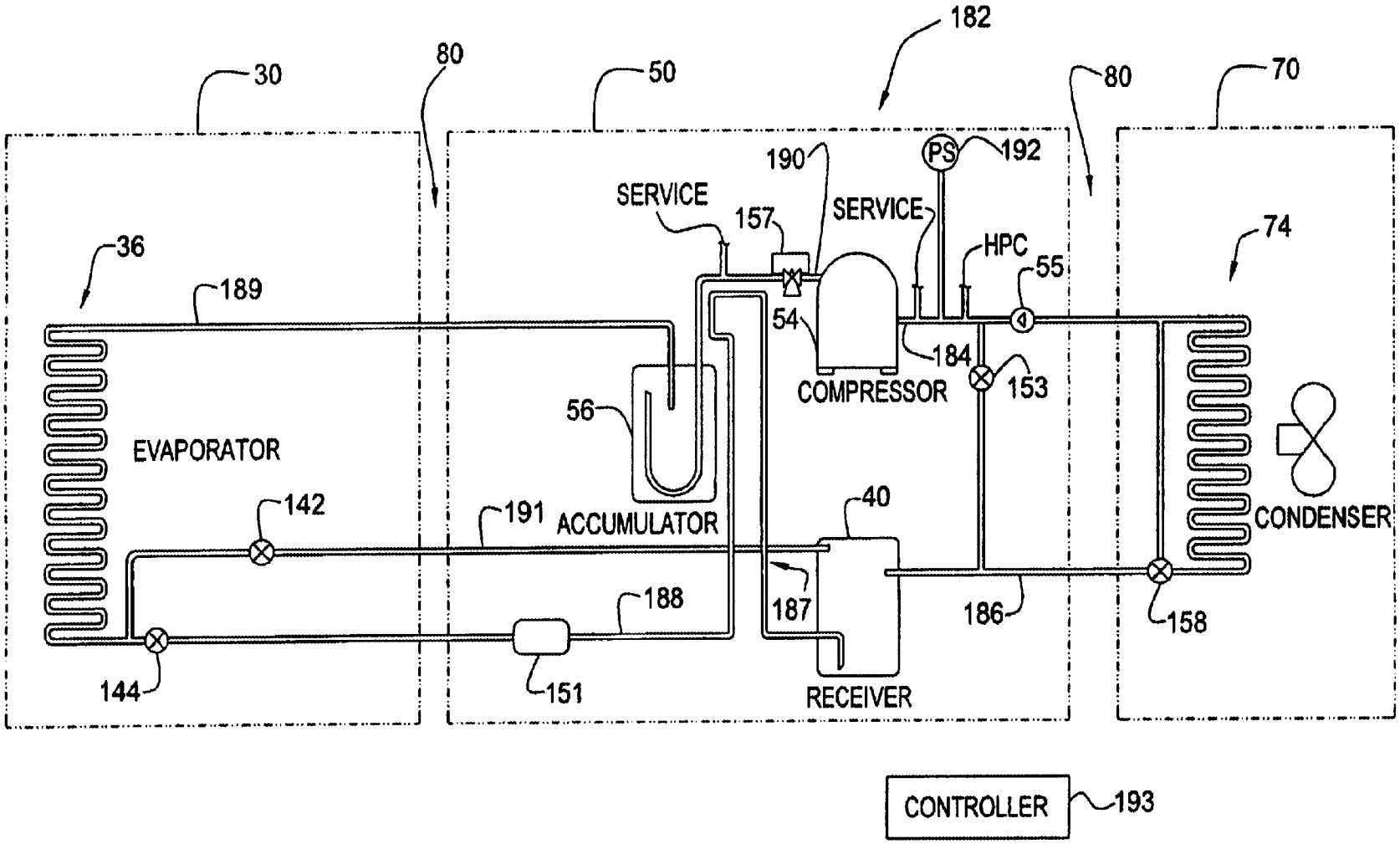
FIG. 4 is a circuit diagram of an alternative refrigerant warm gas circuit that can be used for the quiet ice cube-making machine of FIG. 1.

Referring to FIG. 4, a circuit 182 is shown that may be used with ice cube-making machine 20 of FIG. 1. Circuit 182 includes interconnection structure 80 that connects the components within compressor package 50 to the components within evaporator package 30 and to the components within condenser package 70. In evaporator package 30, evaporator 36 is connected in circuit 182 with a defrost or cool vapor valve 142 and an expansion valve 144. In compressor package 50, receiver 40, compressor 54 and accumulator 56 are connected in circuit 182 with a filter 151, a bypass valve 153 and an output pressure regulator 157. In condenser package 70, condenser 74 is connected in circuit 182 with a head master or head pressure control valve 158. A heat exchanger loop 187 is in thermal relationship with an output tube of accumulator 56 to optimize the use of liquid refrigerant in the accumulator during the freeze cycle.

It will be appreciated by those skilled in the art that evaporator package 30, compressor package 50 and condenser package 70 may include other valves and controls for the operation of ice cube-making machine 20. For example, ice-making machine 20 includes a controller 193 that controls the operations thereof including the activation of bypass solenoid valve 153 during the harvest cycle. Alternatively, a pressure switch 192 during harvest mode can activate solenoid valve 153.

According to a feature of the present invention output pressure valve 157 operates to raise pressure and temperature of the refrigerant in evaporator 36 during ice harvesting.

During a freeze cycle, cool vapor valve 142 and bypass valve 153 are closed and expansion valve 144 is open. Refrigerant flows from an output 184 of compressor 54 via a line 185, condenser 74, head pressure control valve 158, a line 186, receiver 40. Flow continues via heat exchanger loop 187, a supply line 188, filter 151, expansion valve 144, evaporator 36, a return line 189, accumulator 56, output pressure regulator 157 to an input 190 of compressor 54. Output pressure regulator 157 is wide open during the freeze cycle such that the refrigerant passes without any impact on flow.

During a harvest cycle, cool vapor valve 142 and bypass valve 153 are open and expansion valve 144 is closed. Refrigerant in vapor phase flows from the output of compressor 54 via either or both of bypass valve 153 or head pressure valve 158 through line 186 to receiver 40. Flow continues via a vapor line 191, cool vapor valve 142, evaporator 36, return line 189, accumulator 56, output pressure regulator 157 to input 190 of compressor 54.

Output pressure regulator 157 operates during harvest to slow the flow and decrease pressure at input 190 to compressor 54. This results in a higher pressure in evaporator 36 and higher temperature of the vapor in evaporator 36. The higher temperature refrigerant in evaporator 36 enhances the harvest cycle.

Output pressure regulator 157 may be any suitable pressure regulator that is capable of operation at the pressure required in ice-making systems. For example, output pressure regulator may be Model No. OPR 10 available from Alco.

Figure 5:
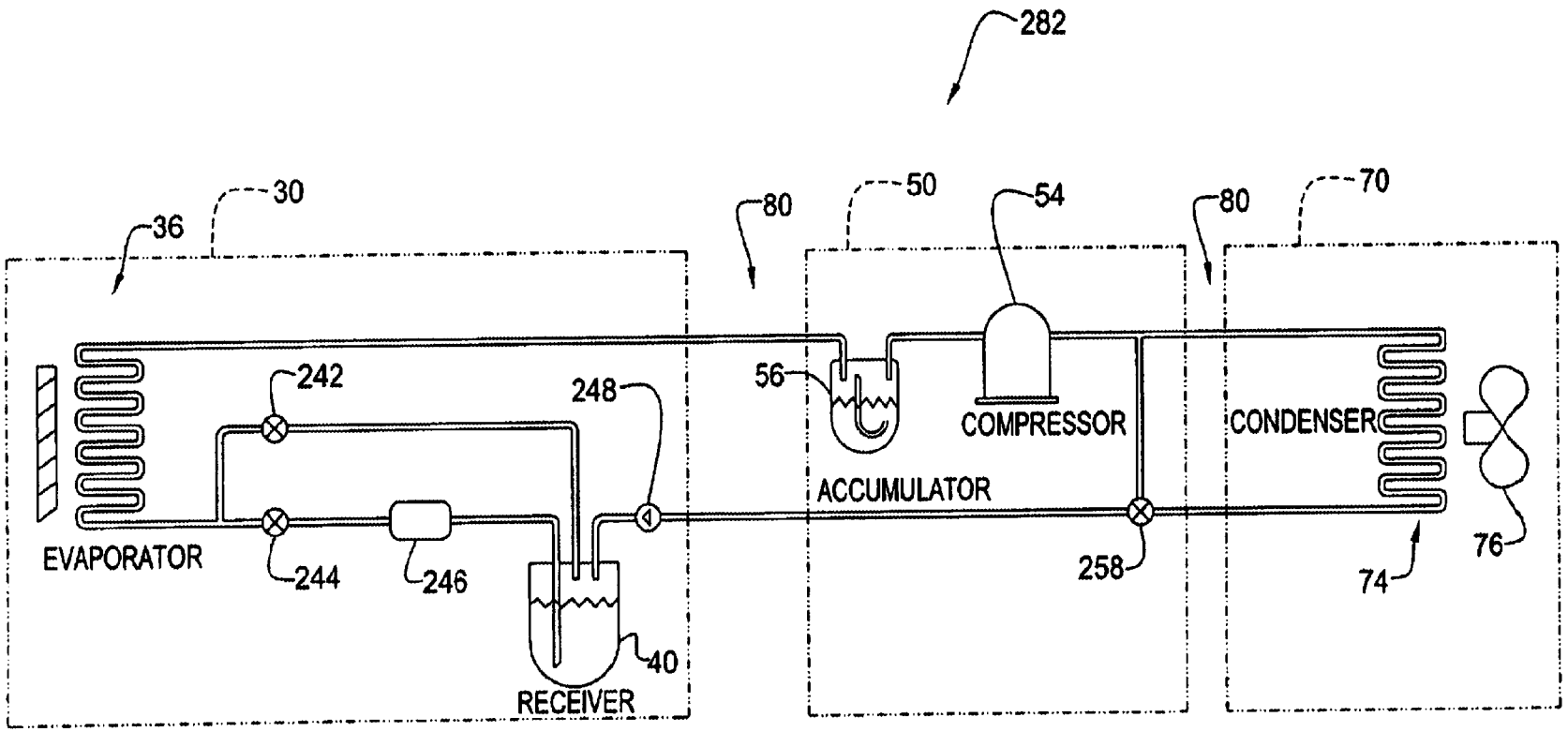
FIG. 5 is a circuit diagram of an alternative refrigerant warm gas circuit that can be used for the quiet ice cube-making machine of FIG. 2.

Referring to FIG. 5, a circuit 282 is shown that may be used with ice cube-making machine 25 of FIG. 2. Circuit 282 includes interconnection structure 80 that connects the components within compressor package 50 to the components within evaporator package 30 and to the components within condenser package 70. In evaporator package 30, evaporator 36 and receiver 40 are connected in circuit 282 with a defrost valve 242, an expansion valve 244, a drier 246 and a check valve 248. In compressor package 50, compressor 54 and accumulator 56 are connected in circuit 282 with a head pressure control valve 258. In condenser package 70, condenser 74 is connected in circuit 282. Head pressure control valve 258 may alternatively be placed in condenser package 70. It will be appreciated by those skilled in the art that evaporator package 30, compressor package 50 and condenser package 70 may include other valves and controls for the operation of ice cube-making machine 20.

Ice cube-making machines 20 and 25 of the present invention provide the advantage of lightweight packages for ease of installation. In most cases, a crane will not be needed. In addition, the evaporator package is rather quiet in operation, as the compressor and the condenser are remotely located. Finally, the distance between evaporator package 30 and condenser package 70 is greatly enhanced to approximately 70 feet in height from the 35 feet height constraint of the prior art two package system.

Figure 6:
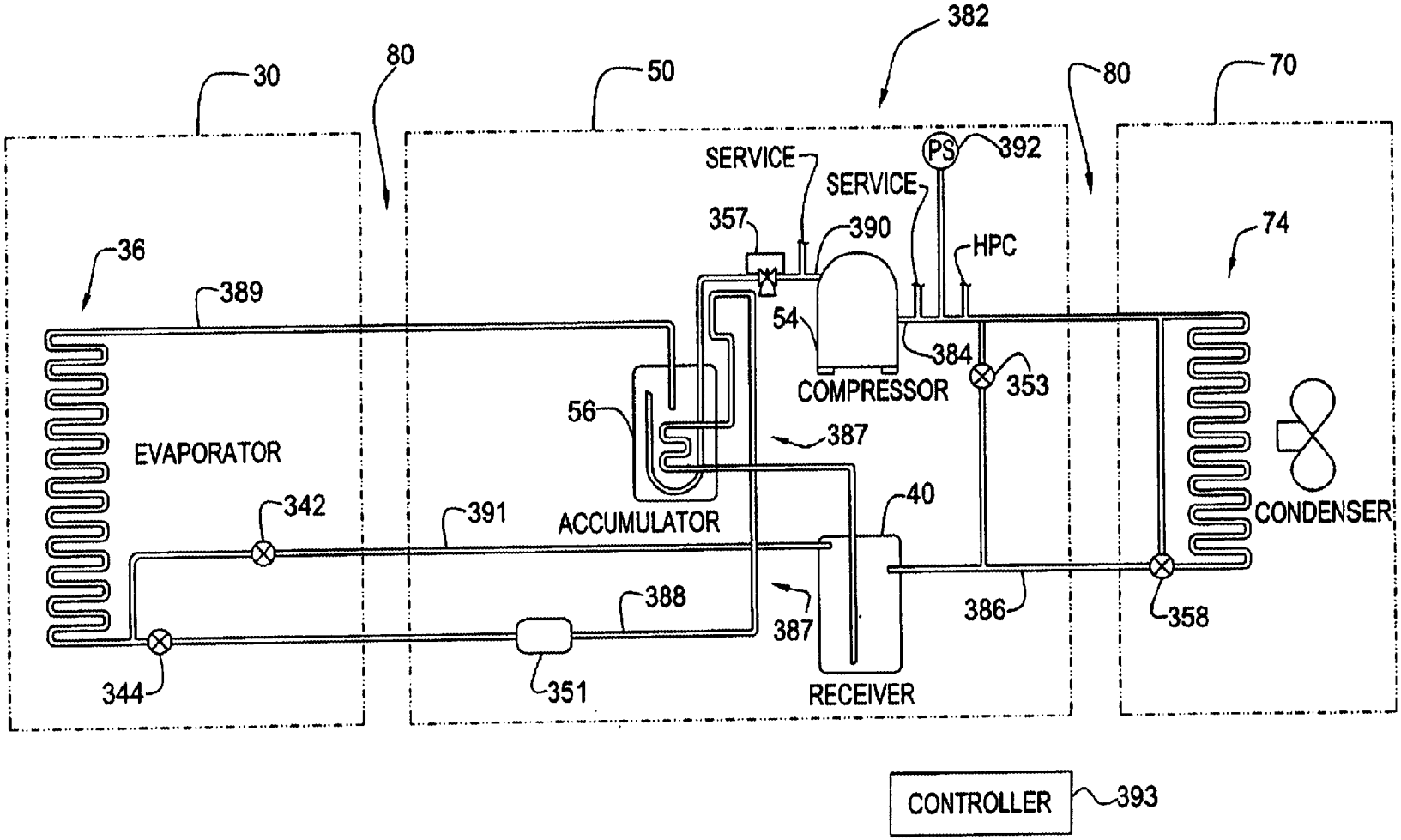
FIG. 6 is circuit diagram of another alternative refrigerant warm gas circuit that can be used for the quiet ice-cube making machine of FIG. 1.

Referring to FIG. 6, a circuit 382 is shown that may be used with ice cube-making machine 20 of FIG. 1. Circuit 382 includes interconnection structure 80 that connects the components within compressor package 50 to the components within evaporator package 30 and to the components within condenser package 70. In evaporator package 30, evaporator 36 is connected in circuit 382 with a defrost or cool vapor valve 342 and an expansion valve 344. In compressor package 50, receiver 40, compressor 54 and accumulator 56 are connected in circuit 382 with a filter 351, a bypass valve 353, a head master or head pressure control valve 358 and an output pressure regulator 357. A heat exchanger loop 387 passes through accumulator 56 and is in thermal relationship with an output tube of accumulator 56 to optimize the use of liquid refrigerant in the accumulator during the freeze cycle.

It will be appreciated by those skilled in the art that evaporator package 30, compressor package 50 and condenser package 70 may include other valves and controls for the operation of ice cube-making machine 20. For example, ice-making machine 20 includes a controller 393 that controls the operations thereof including the activation of bypass solenoid valve 353 during the harvest cycle. Alternatively, a pressure switch 392 during harvest mode can activate solenoid valve 353.

According to a feature of the present invention output pressure valve 357 operates to raise pressure and temperature of the refrigerant in evaporator 36 during ice harvesting.

During a freeze cycle, cool vapor valve 342 and bypass valve 353 are closed and expansion valve 344 is open. Refrigerant flows from an output 384 of compressor 54 via a line 385, condenser 74, head pressure control valve 358 and a line 386 to receiver 40. Flow continues via heat exchanger loop 387, a supply line 388, filter 351, expansion valve 344, evaporator 36, a return line 389, accumulator 56, output pressure regulator 357 to an input 390 of compressor 54. Output pressure regulator 357 is wide open during the freeze cycle such that the refrigerant passes without any impact on flow.

During a harvest cycle, cool vapor valve 342 and bypass valve 353 are open and expansion valve 344 is closed. Refrigerant in vapor phase flows from the output of compressor 54 to a vapor line 391 via either or both of a first path that includes bypass valve 353 or a second path that includes head pressure valve 358 line 386 and receiver 40. Flow continues via vapor line 391, cool vapor valve 342, evaporator 36, return line 389, accumulator 56, output pressure regulator 357 to input 390 of compressor 54.

Output pressure regulator 357 operates during harvest to slow the flow and decrease pressure at input 390 to compressor 54. This results in a higher pressure in evaporator 36 and higher temperature of the vapor in evaporator 36. The higher temperature refrigerant in evaporator 36 enhances the harvest cycle.

Figure 7:
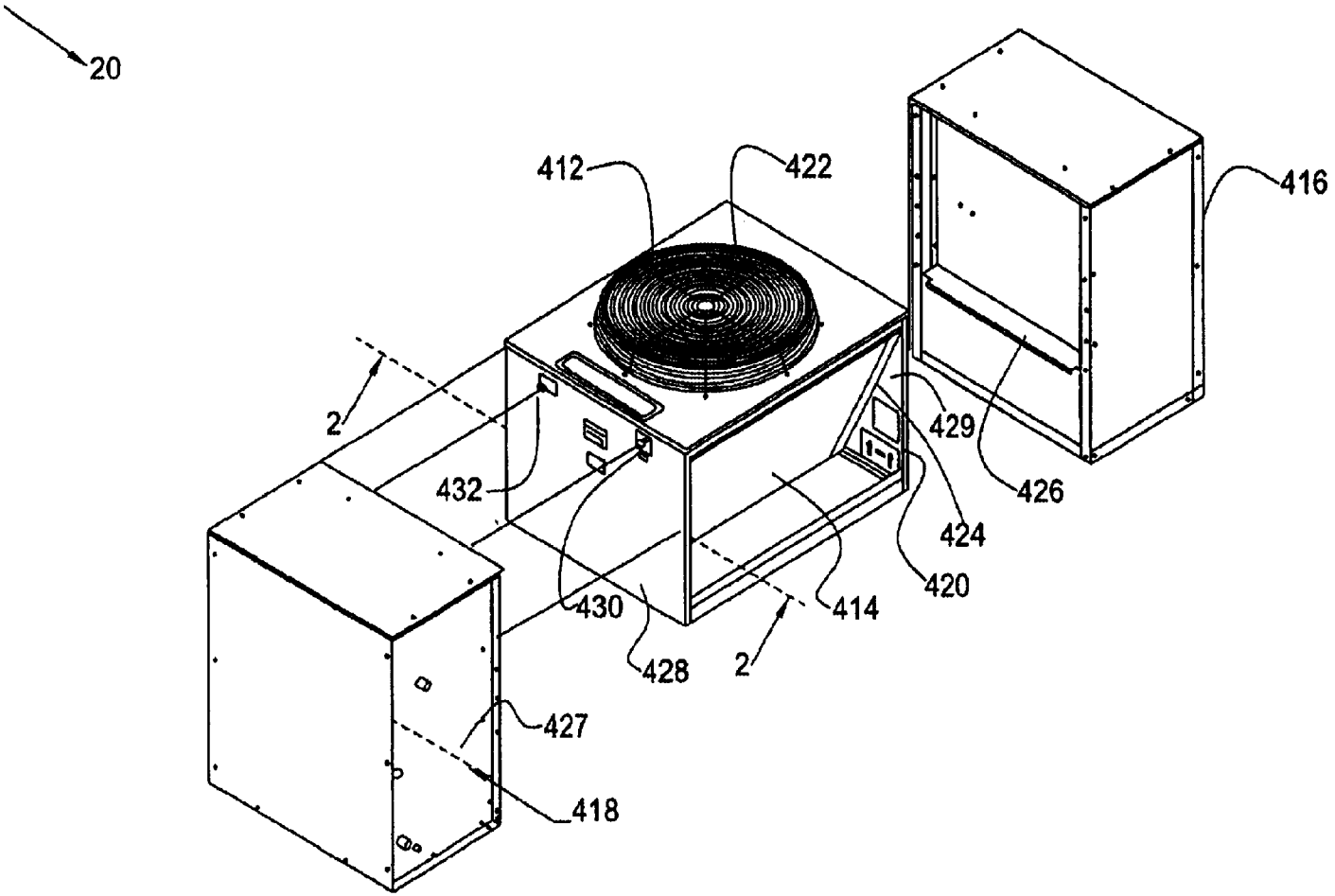
FIG. 7 is a is a perspective view, of another exemplary embodiment of the ice cube making machine with the dual loop condenser of the present invention.
Figure 8:
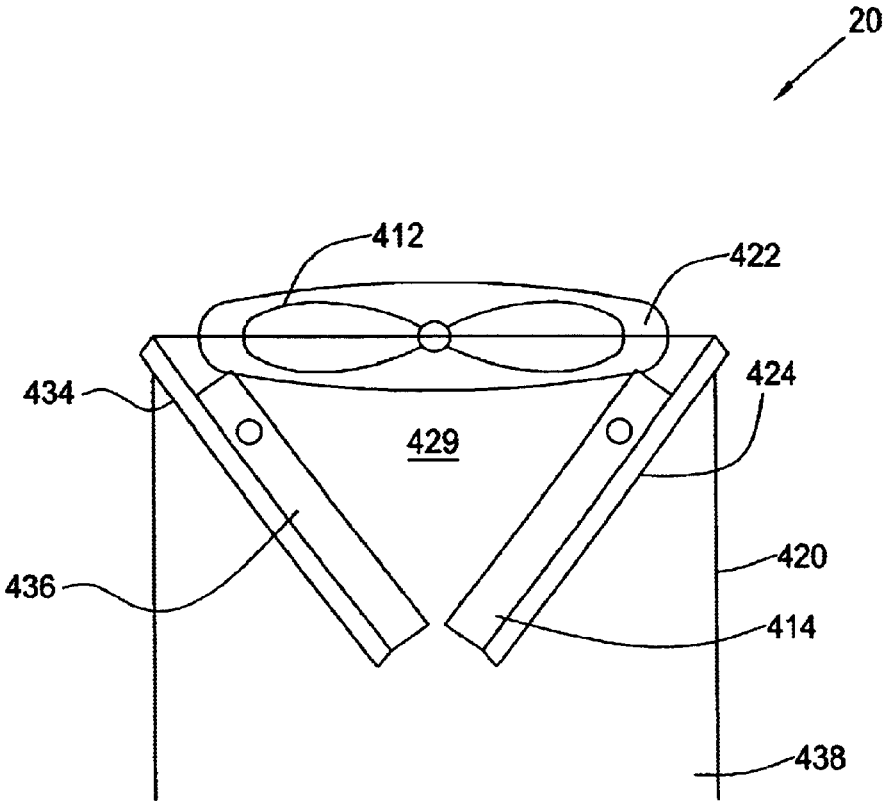
FIG. 8 is a view along line 2—2 of FIG. 7.

Referring now to FIGS. 7 and 8, there is provided another exemplary embodiment of an ice-making machine 20. Ice-making machine 20 includes a single fan 412, a first condenser 414, a second condenser 436, a first compressor 416, and a second compressor 418. The first condenser 414 and the first compressor 416 are adapted to connect with one another to form a first refrigerant circuit that includes an evaporator and the other typical refrigerant components. The second condenser 436 and the second compressor 418 also are adapted to connect with one another in a second refrigerant circuit that includes an evaporator and the other typical refrigerant components. An ice bin or hopper (not shown) may be disposed between an evaporator (not shown) to receive ice cubes during a harvest mode. First condenser 414 and the second condenser 436 rest in a support structure 420. An exemplary aspect of the support structure 420 is that the support structure 420 is a box-like structure having an aperture 422. Aperture 422 is a suitable size for allowing fan 412 access to air to circulate and cool the first condenser 414 and second condenser (not shown). It should be appreciated by those skilled in the art, that fan 412 may be disposed in any suitable manner to cool first condenser 416 and second condenser 436.

Support structure 420 also includes a first support element 424 and a second support element 434. First support element 424 and second support element 434 are attached to one another. First support element 424 and second support element 434 are configured to be attached by any known method in the art for connecting the first support element 424 and the second support element 434 in a V configuration. The first condenser 414 and the second condenser 436 rest upon the respective first support element 424 and the second support element 434 within support structure 420.

First support element 424 is attached to the interior of support structure 420 to provide suitable structural support to first condenser 414. Second support element 434 is also attached to the interior of support structure 420 to provide suitable structural support to second condenser 436. An exemplary aspect of first support element 424 and second support element 434 is that first and second support elements are dimensioned to allow an air stream to circulate there through from the ambient via aperture 422. Support structure 420 also has a second aperture 438 disposed on the bottom of support structure 420. Aperture 438 extends the width of the support structure 420 to allow the interior of the support structure 420 to be exposed to the ambient and contribute to cooling of first condenser 414 and second condenser 434 and to contribute to the heat transfer to ambient.

First compressor 416 includes a first flange 426. The second compressor 418 also has a second flange 427. Support structure 420 is adapted to rest on first flange 426 disposed on the first compressor 416 and the second flange 427 on the second compressor 418. Preferably, first flange 426 and second flange 427 are suitable to hold the weight of the support structure 420 with the weight of the first condenser 416 and the second condenser 436 disposed within support structure 420. First compressor 416 and second compressor 418 are positioned such that support structure 420 rests on first flange 426 and second flange 427.

Support structure 420 also includes a first lateral side 428 and a second lateral side 429. Disposed in the first lateral side 428 and second lateral side 429 are a plurality of apertures for connecting the first condenser 414 and second condenser (not shown) to the respective first compressor 416 and second compressor 418.

It should be appreciated by one skilled in that art that although first support element 424 and second support element 434 are connected to the support structure 420 in a V configuration, first and second support elements 424, 434 may arranged in any configuration so as to create a compact configuration of multiple condensers. It should also be appreciated by one skilled in the art, that support structure 420 rests on first flange 426 and second flange 427 so as to provide suitable height, relative to the ground, to allow air to circulate through support structure 420 via aperture 422 and underneath the support structure 420 through second aperture 438 as shown in FIG. 8.

Referring to FIG. 7, first lateral side 429 has a corresponding supply line (not shown) and a return line (not shown) for circulating refrigerant from the first compressor 416 to the first condenser 414 to define the first refrigerant circuits. Second lateral side 428 has corresponding supply line 430 and a corresponding return line 432 for circulating refrigerant from the second compressor 418 to the second condenser (not shown) to define the second refrigerant circuit. The first and second refrigeration circuit may be any suitable refrigeration circuit known in the art or known in the future.

Figure 9:
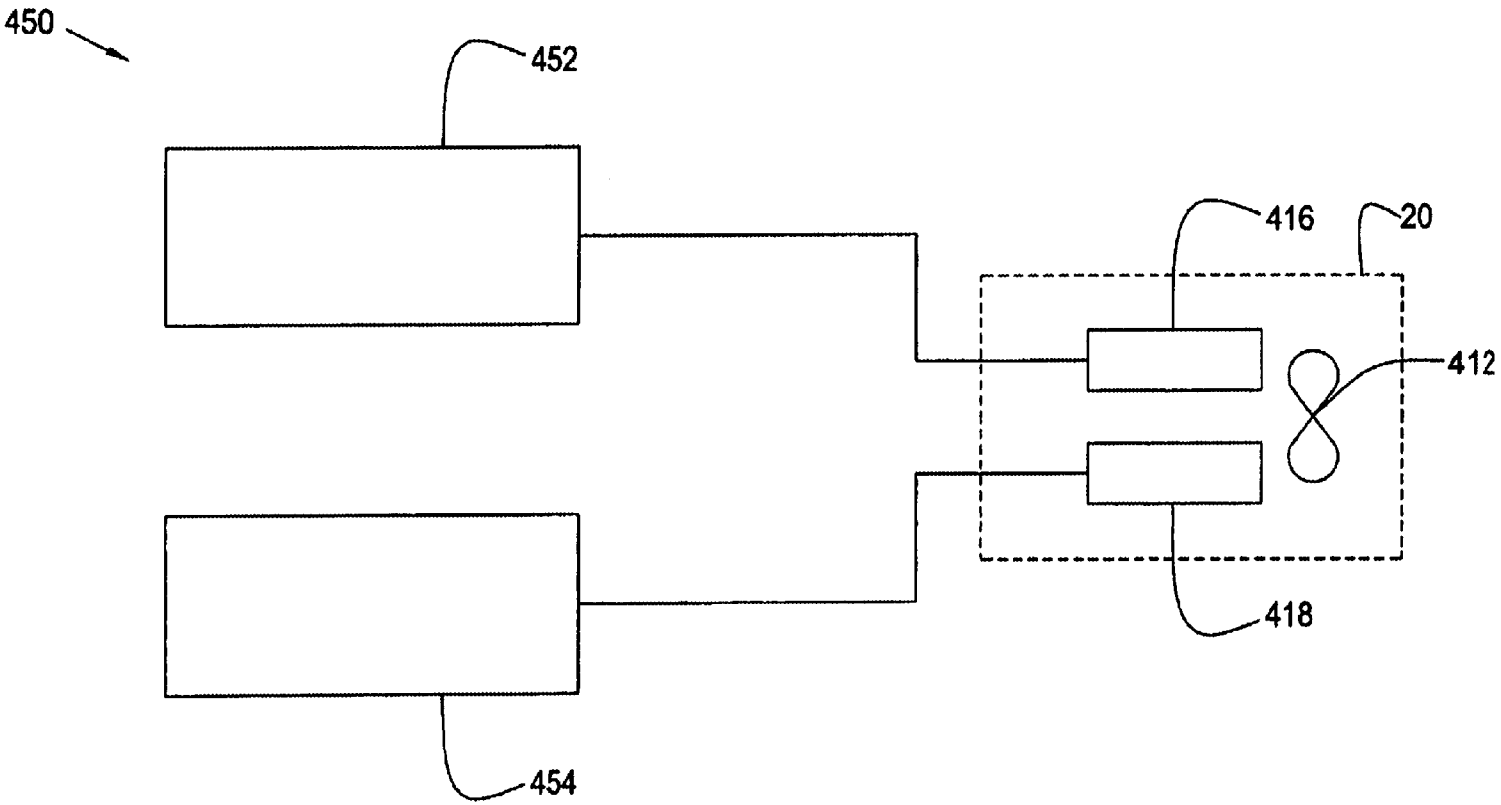
FIG. 9 is a circuit diagram of the ice cube-making machine of FIG. 7.

With reference to FIG. 9, a circuit 450 is shown that may be used with the FIG. 7 ice-cube-making machine. Circuit 450 includes an interconnection structure that connects the components to form a first ice making system 452. Circuit 450 also includes an interconnection structure that connects the components to form a second ice making system 454. First ice making system 452 is connected to first condenser 416. Second ice making system 454 is connected to second condenser 418. First condenser 416 and second condenser 418 are disposed in support structure 420 adjacent fan 412. First ice making system 452 and the second ice making system 454 may be any suitable ice making system known in the art or known in the future.

Figure 10:
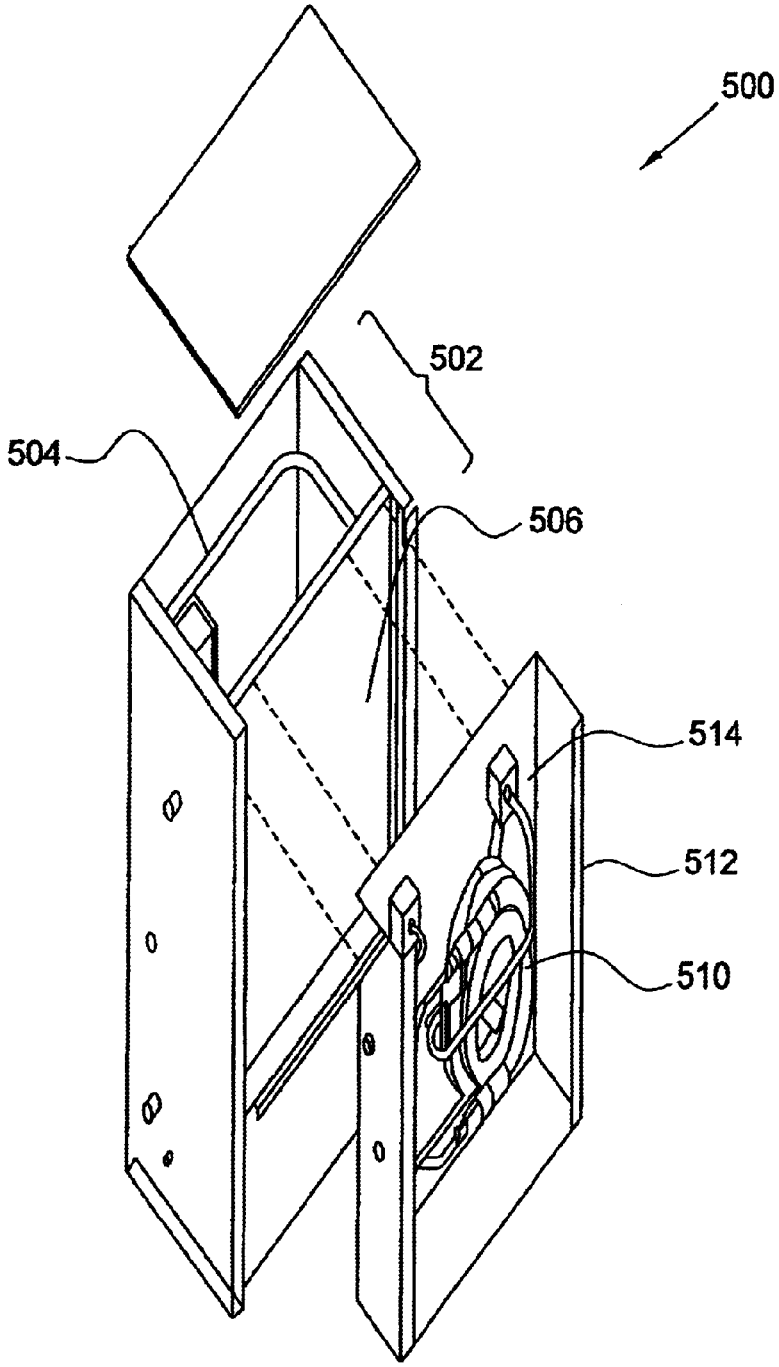
FIG. 10 is a is a perspective view, of another exemplary embodiment of the ice cube making machine with the dual loop condenser of the present invention.

With reference to FIG. 10, there is provided another exemplary embodiment of a package 500 that includes a first compressor 502 and a condenser 510. As will be understood from the drawings, package 500 includes a support structure 504. Support structure 504 is disposed within the interior of compressor package 502. An exemplary aspect of compressor package 502 is that support structure 504 houses a compressor (not shown). As will be appreciated by one skilled in the art, air cooled condensers are not economically feasible given the space requirements and location of the condensers disposed in smaller, urban locations. For example, in urban locations when the compressor package 502 is located in the lower floor of a building and the roof is more than thirty five feet above, the air cooled condensers will not be able to function in a beneficial capacity, given the heat transfer experienced in the thirty five feet distance. This limiting aspect can be detrimental in urban installations, given the existence of high rise buildings. If the packages are placed closer to each other to utilize air cooled condensers, this may result in a more noisy ice-cube making machine.

However, generally high rise buildings typically have an abundant supply of chilled water or fluid. These chilled water or fluid systems are circulating throughout the building. As such, the present exemplary embodiment, utilizes the abundant chilled water supply to provide the customer even greater installation flexibility of the compressor package 502. Referring to FIG. 10, there is provided a compressor package 502. Compressor package 502 has a support structure 504. Preferably, compressor package 502 includes an aperture 506 disposed in a lateral side of compressor package 502. Aperture 506 reveals a lateral side of support structure 504. Aperture 506 is of a suitable depth to mate with an insert package 512. Insert package 512 houses a water cooled condenser 510 and a water regulating valve 514. As will be understood, water regulating valve 514 may be any suitable device for connecting the building's chilled water system to condenser 510 and the attendant refrigerant circuit (not shown). It should be appreciated that any suitable refrigerant circuit known in the art may be used in the present embodiment. It should also be appreciated by one skilled in the art, that insert package 512 may be attached to compressor package 502 by any suitable fasteners currently known in the art or known in the future. In this manner, the compressor package 502 may be installed at a suitable remote distance away from, for example the evaporator (not shown) while simultaneously not squandering productive operational cooling qualities that are normally lost from heat transfer over a greater distance than about 35 feet.

The present invention having been thus described with particular reference to the preferred forms thereof, it will be obvious that various changes and modifications may be made therein without departing from the spirit and scope of the present invention as defined in the appended claims.

What is claimed is:

1. An ice-making machine comprising:

a first compressor disposed in a first support structure;

a second compressor disposed in a second support structure;

a first condenser, a second condenser and a fan disposed in a third support structure;

a first evaporator support structure having a first evaporator in fluid communication with said first compressor and said first condenser for circulation of refrigerant;

a second evaporator support structure having a second evaporator in fluid communication with said second compressor and said second condenser for circulation of refrigerant; and a first and second hopper to receive ice cubes formed by said first and second evaporators, wherein said third support structure is disposed in between said first and said second support structures, and wherein said fan, when operated, draws air to provide cooling to said first and second condensers.

2. The ice-making machine of claim 1, further comprising a first and a second aperture disposed in said third support structure, said third support structure having said fan disposed in said first aperture, wherein said fan, when operated, draws air from said second aperture to cool said first and said second condensers.

3. The ice-making machine of claim 1, wherein said third support structure is disposed in between said first and said second support structures in suspension so that said fan, when operated, draws air to provide cooling to said first and second condensers.

4. The ice-making machine of claim 2, further comprising a first flange disposed on said first support structure and a second flange disposed on said second support structure.

5. The ice-making machine of claim 4, wherein said third support structure rests on said respective first and said respective second flanges.

6. The ice-making machine of claim 5, wherein said third support structure comprises a first and second support element disposed in said interior of said third support structure, said first and second support elements being disposed in a V configuration with respect to said third support structure, whereupon said first condenser is disposed on said first support element and said second condenser is disposed on said second support element.

7. The ice-making machine of claim 1, further comprising a first and second aperture disposed in said third support structure, wherein said first and second condensers are substantially disposed between said first and second apertures, and wherein said fan, when operated, draws air from said second aperture to cool said first and second condensers.

8. The ice-making machine of claim 1, further comprising a first and second aperture disposed in said third support structure, wherein said fan, when operated, creates an air-flow path between said first and second apertures to cool said first and second condensers, and wherein said air flow path substantially traverses said first and second condensers.

9. The ice-making machine of claim 7, wherein said fan is at least partially disposed in said first aperture.

10. The ice-making machine of claim 8, wherein said fan is at least partially disposed in said first aperture.

11. The ice-making machine of claim 1, wherein said first and second condensers are disposed in a V configuration in said third support structure.

12. The ice-making machine of claim 11, wherein said third support structure comprises a first and second support element disposed in an interior of said third support structure, wherein said first and second support elements are disposed in a V configuration, end wherein said first condenser is disposed on said first support element and said second condenser is disposed on said second support element.

13. The ice-making machine of claim 11, further comprising a first and second aperture disposed in said third support structure, wherein said first and second condensers are substantially disposed between said first and second apertures, and wherein said fan, when operated, draws air from said second aperture to cool said first and second condensers.

14. The ice-making machine of claim 11, further comprising a first and second aperture disposed in said third support structure wherein said fan, when operated, creates an air flow path between said first and second apertures to cool said first and second condensers, and wherein said air flow path substantially traverses said first and second condensers.

15. The ice-making machine of claim 1, further comprising a pressure regulator downstream of said first evaporator or said second evaporator, wherein during a harvest cycle said pressure regulator limits flow of said refrigerant through said first evaporator or said second evaporator, whereby the pressure and temperature of said refrigerant in said first or second evaporators increases to thereby assist in defrosting said first or second evaporators to harvest ice.

16. The ice-making machine of claim 15, wherein during said harvest cycle said pressure regulator reduces flow of said refrigerant through said first or second evaporators as compared to the flow during a freeze cycle, without stopping said flow.

* * * * *